US005227117A

United States Patent [19]

Derucki

[11] Patent Number: 5,227,117

[45] Date of Patent: Jul. 13, 1993

[54] APPARATUS FOR BLAST FURNACE FUEL INJECTION

[75] Inventor: Julian D. Derucki, Center Township, Porter County, Ind.

[73] Assignee: USX Corporation, Pittsburgh, Pa.

[21] Appl. No.: 889,897

[22] Filed: May 29, 1992

[51] Int. Cl.[5] ..... C21B 7/16

[52] U.S. Cl. ..... 266/182; 266/221; 266/267

[58] Field of Search ..... 266/47, 182, 265, 266, 266/267, 268, 218, 221; 75/459, 460, 461, 462, 463, 464

[56] References Cited

U.S. PATENT DOCUMENTS

| | | | |
|---|---|---|---|
| 966,704 | 8/1910 | Pickles . | |
| 3,197,305 | 7/1965 | Carlson . | |
| 3,209,810 | 10/1965 | Schuvart | 158/76 |
| 3,809,524 | 5/1974 | Bruhlet et al. | 431/181 |
| 3,833,356 | 9/1974 | Luth | 75/462 |
| 3,856,509 | 12/1974 | Heynert et al. . | |
| 3,917,243 | 11/1975 | Borgnat et al. | 266/41 |
| 3,970,290 | 7/1976 | Santen et al. | 266/138 |
| 4,700,930 | 10/1987 | Pressigny et al. | 266/267 |
| 4,759,532 | 7/1988 | Illuminati | 266/182 |
| 4,771,993 | 9/1988 | Zanetta et al. | 266/267 |

FOREIGN PATENT DOCUMENTS

| | | | |
|---|---|---|---|
| 44096 | 1/1982 | European Pat. Off. | 266/47 |
| 53-087908 | 8/1978 | Japan | 75/462 |
| 1-028312 | 1/1989 | Japan | 75/460 |
| 522234 | 3/1974 | U.S.S.R. | 266/268 |
| 908812 | 7/1980 | U.S.S.R. . | |
| 910769 | 7/1980 | U.S.S.R. | 266/268 |
| 1632976 | 3/1991 | U.S.S.R. | 266/265 |

*Primary Examiner*—Melvyn J. Andrews
*Attorney, Agent, or Firm*—William F. Riesmeyer, III

[57] ABSTRACT

A blast furnace blowpipe is provided having multipe bosses for a plurality of fuel injection lances spaced around the periphery of the blowpipe.

4 Claims, 3 Drawing Sheets

APPARATUS FOR BLAST FURNACE FUEL INJECTION

TECHNICAL FIELD

This invention relates to apparatus for injection of increased amounts of fuel into a blast furnace, and particularly to a plurality of lances for injection of fuel into a blast furnace blowpipe.

In the iron blast furnace, ore is introduced at the top of the furnace shaft along with coke and limestone. As these materials descend through the furnace, coke is burned by oxygen enriched air injected through tuyeres spaced around the periphery of a lower portion of the shaft. Combustion of the coke releases carbonaceous gases which rise through the materials to heat and reduce the ore. Molten iron saturated with carbon collects at the base of the shaft covered with a liquid slag derived from the limestone flux.

BACKGROUND ART

A large bustle pipe extends around the outer periphery of the shaft for the delivery of air from hot blast stoves to the furnace tuyeres. A gooseneck pipe extends downwardly from the bustle pipe to a tuyere stock and a blowpipe connected to each tuyere. It is known that the injection of fuel with the hot blast oxygen enriched air fed through the tuyeres can eliminate a substantial part of the coke to reduce the cost of the charge materials. The fuel may be gaseous, liquid or solid carbonaceous material. It may be injected through a lance extending into the tuyere or the blowpipe, or a lance extending through the tuyere stock into the blowpipe or tuyere.

For example, a number of references disclose injection of fuel into a blast furnace tuyere rather than into a blowpipe connected to the tuyere as in applicant's invention. U.S. Pat. Nos. 966,704; 3,197,305; 3,809,524; 3,856,509 each show a single lance for injection of fuel into a blast furnace tuyere. U.S. Pat. No. 3,833,356 shows a lance extending through a pipe connected to the tuyere for injection of fuel along the longitudinal centerline of the tuyere. U.S. Pat. No. 3,917,243 discloses a plurality of fuel supply passages spaced around the periphery of a supersonic blast furnace tuyere between convergent and divergent portions thereof. Russian patent SU 908,812 shows alternate passages for injection of gaseous fuel to the top of a blast furnace tuyere. Another Russian patent SU 910,769 discloses two gas feed tubes for injection of gaseous fuel to the top and bottom of a tuyere. This reference does not disclose a plurality of lances extending into a blowpipe. The gas feed tubes terminate at the wall defining the passage in the tuyere. SU 522,234 shows a lance for injection of gaseous fuel to the top of a tuyere and a separate lance for injection of solid fuel into the bottom of a blowpipe connected to the tuyere.

Other references do disclose lances or passages for injection of fuel into a blowpipe but not the multiple lances of applicant's invention. U.S. Pat. No. 3,209,810 shows a lance for injection of gaseous or liquid fuel into the top of a blast furnace blowpipe. Japanese published patent application J53,087,908 discloses a tube for flowing oil into the bottom of a blast furnace blowpipe. A separate tube 9 is provided for blowing air containing steelmaking dust into the top of the blowpipe. U.S. Pat. No. 4,700,930 shows a branch connection 8 for injection of solid carbonaceous materials into the top of a nozzle connected to a blast furnace tuyere. In summary, none of the references disclose multiple lances for injection of fuel into a blast furnace blowpipe according to applicant's invention.

DISCLOSURE OF INVENTION

According to this invention, a plurality of lances are provided for the injection of fuel into each blowpipe connected to a tuyere in a blast furnace. The lances extend angularly through the outer wall of the blowpipe and terminate at locations within the passage spaced a sufficient distance from the blowpipe wall so that combustion of the fuel will not overheat the blowpipe. The axis of each lance is aimed at a point adjacent the interior end of the blowpipe on the centerline of the passage therein. An interior end of each lance is spaced from said point a sufficient distance to permit ignition of the fuel from each lance separately before substantial mixing of the fuel occurs at said point. The maximum spacing of said point from the interior end of the blowpipe being limited so that combustion takes place primarily in the tuyere and overheating of the blowpipe does not occur.

I have found that locating the lances as set forth above results in separate combustion of the fuel from each lance before substantial mixing of the two fuel streams occur. With separate combustion zones, complete combustion of the fuel is achieved and residue of uncombusted fuel is not found in the water outlet of the venturi scrubber. Observation of separate combustion zones has been made by viewing separate plumes of fuel from each lance through the peepsight in the tuyere stock. When the lances are too close to the point on the centerline, a single plume is observed and unburned residue of fuel is found in the water from the venturi scrubber. Thus, multiple lances positioned according to my invention permit increased fuel injection and reduction of coke usage.

MODES FOR CARRYING OUT THE INVENTION

Figure 1:
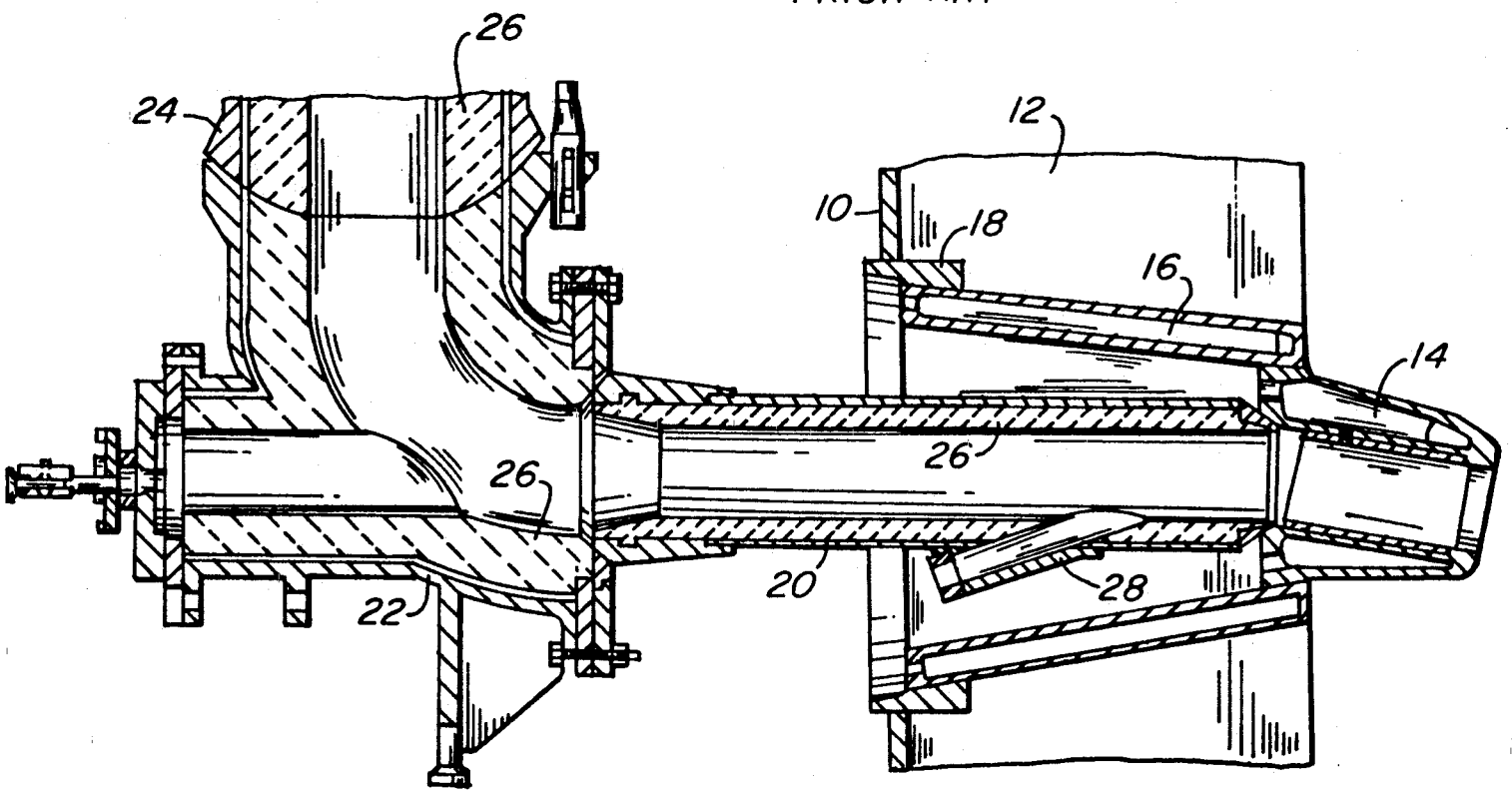
FIG. 1 PRIOR ART
FIG. 1 is a section of a blast furnace tuyere with a blowpipe having a boss for a single fuel injection lance as in the prior art.

Referring to FIG. 1, a blast furnace comprises a cylindrical metal shell shown in part at 10 lined with refractory 12. A plurality of water cooled tuyeres, one which is shown at 14, are provided at spaced locations around the lower periphery of the furnace for flowing oxygen enriched air into the charge materials in the furnace. A tuyere cooler 16 is mounted between a cooler holder 18 and tuyere 14. A blowpipe 20 serves to connect the tuyere to tuyere stock 22. Gooseneck partially shown at 24 is connected between the tuyere stock and bustle pipe (not shown). The blowpipe, tuyere stock and gooseneck are lined with castable refractory material 26. According to the prior art, a single boss 28 is provided at the bottom of blowpipe 20 for a fuel injection lance (not shown).

Figure 2:
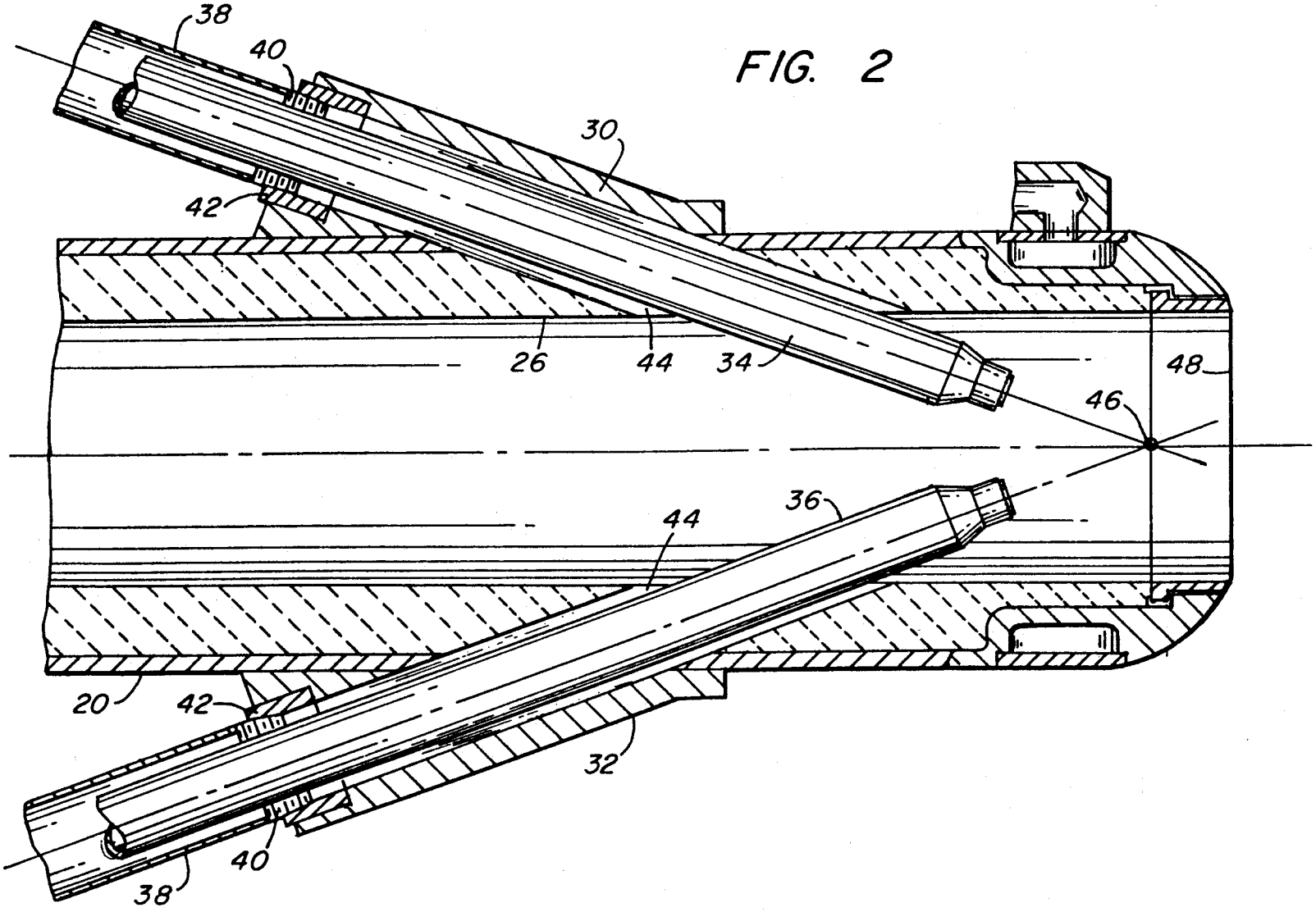
FIG. 2 is a plan view in section of a blowpipe having double boss sections and two fuel injection lances in accordance with this invention.

Referring to FIG. 2, a pair of bosses 30 and 32 are provided according to this invention at spaced locations on the peripherey of blowpipe 20. Fuel injection lances 34 and 36 consisting of 1.5 inch (38.1 mm) copper tube are mounted in each boss. A 2 inch standpipe 38 having threaded end 40 is mounted in the fuel boss insert 42 to center the lance through to hole 44 in the side wall of blowpipe 20 and the refractory lining 26. The axis of each lance is directed toward a point 46 adjacent to an interior end 48 of blowpipe 20. Point 46 is located a minimum distance from the interior end of the blowpipe to permit sufficient residence for mixing fuel and air so as to obtain complete combustion. The maximum spacing of point 46 from the interior end of blowpipe 20 is limited to that in which overheating of the blowpipe will not occur. Preferably, point 46 is located a distance within the range of from about 1 inch (25.4 mm) to about 5 inches (127.0 mm) from the interior end of the blowpipe.

Figure 3:
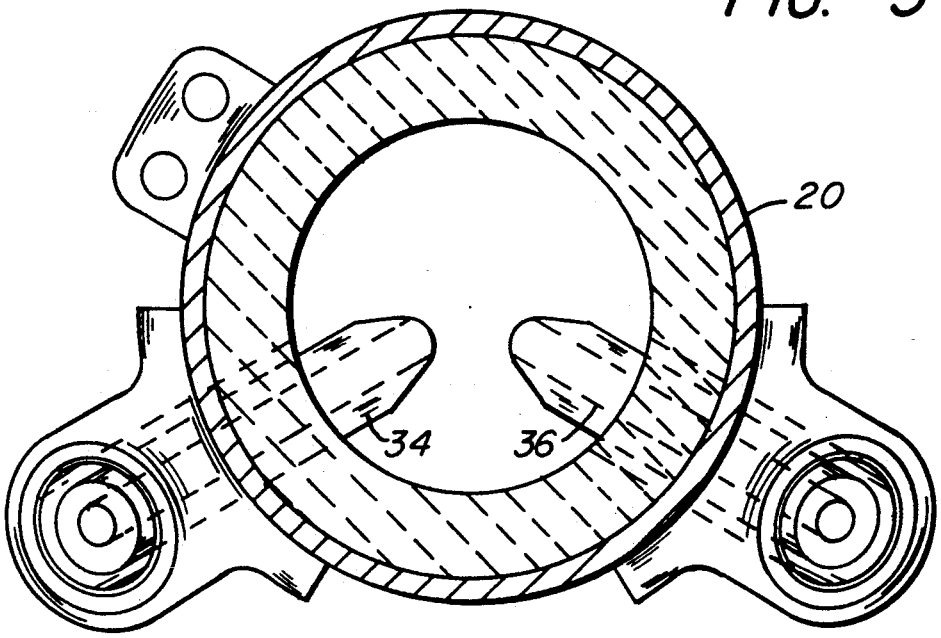
FIG. 3 is an end view taken at III—III of FIG. 2.

Referring to FIG. 3, the two fuel injection lances are spaced 120 degrees apart on the lower half of the periphery of blowpipe 20. The lances may be spaced apart within a range of from about 90 to 180 degrees and may be located on either the upper half, the lower half or both portions of the periphery of the blowpipe. Most preferably, the lances would be located about 180 degrees apart at the 3'oclock and 9'oclock positions if space permits.

Referring again to FIG. 2, the inner end of each lance is spaced a sufficient distance from the refractory wall 26 of the blowpipe to prevent overheating due to combustion of fuel adjacent thereto. The inner end of each lance is also spaced a sufficient distance from point 46 to permit ignition of the stream of fuel from each lance separately before substantial mixing occurs with the fuel from the other lance. Preferably, the inner end of each lance is located at a distance within a range of from about 2 inches (50.8 mm) to about 6 inches (152.4 mm) from point 46. Generally, the spacing of lances from point 46 will be greater when a plurality of lances are used than the spacing from said point in a single lance prior art configuration. Most preferably, the spacing will be within a range of from about 2.5 inches (63.5 mm) to about 5 inches (127.0 mm). As shown in FIG. 2, the axis of each lance is at an acute angle with respect to centerline 50 of blowpipe 20. Preferably, the lances are aligned at an angle within the range of from about 10 to about 30 degrees with respect to centerline 50.

Figure 4:
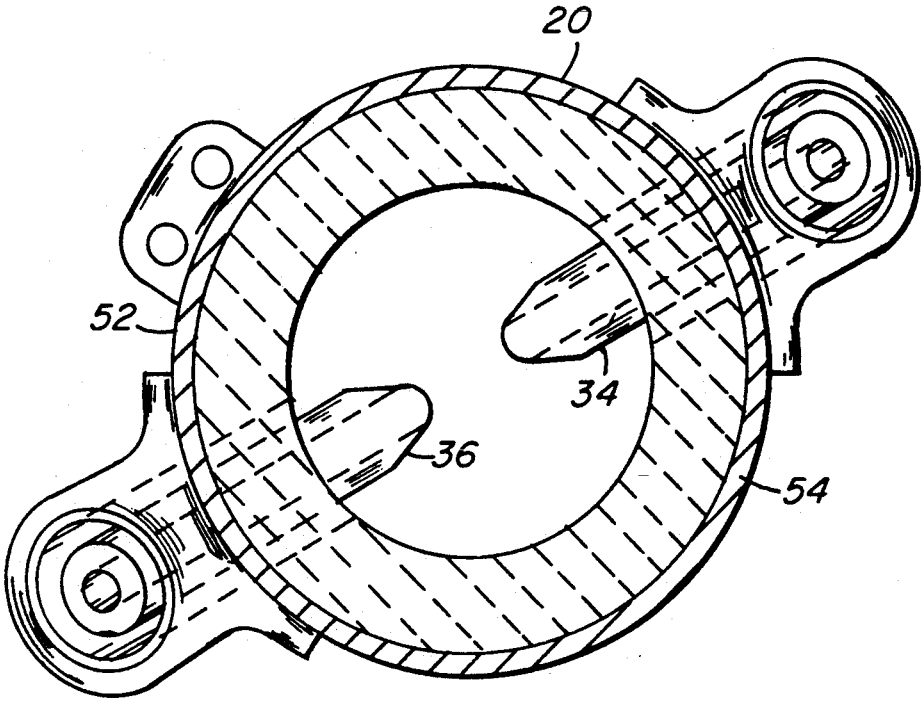
FIG. 4 is an end view similar to FIG. 3 of an alternate embodiment of the invention.

Referring to FIG. 4, an alternate embodiment of the invention is shown with fuel injection lances 34 and 36 located 180 degrees from each other in blowpipe 20. Lance 34 is located on an upper half 52 of the periphery of blowpipe 20. Lance 26 is located on a lower half 54 of the periphery of the blowpipe.

It will be apparent to those skilled in the art that various modifications in the arrangement and design of a blowpipe with plural fuel lances may be made without departing from the spirit and scope of the invention as set forth in the claims appended hereto.

Industrial Applicability

The present invention is applicable to blast furnace apparatus for the reduction of iron or other metallic ores.

I claim:

1. A blast furnace blowpipe for injection of increased amounts of fuel, said blowpipe characterized by a plurality of fuel injection lances at spaced locations around the periphery of the blowpipe, said lances extending through a wall of the blowpipe and making an acute angle therewith, each said lances terminating at an inner end at a location within a passage in the blowpipe spaced a sufficient distance from the blowpipe wall so that combustion of the fuel will not overheat the blowpipe, the axis of each lance being directed toward a point adjacent an interior end of the blowpipe adapted to be connected to a blast furnace tuyere, said point being located on a centerline of the passage in the blowpipe and being spaced from the interior end of the blowpipe a distance within the range of from about 1 inch (25.4 mm) to about 5 inches (127.0 mm), the inner end of each lance being spaced from said point a distance within the range of from about 2 inches (50.8 mm) to about 6 inches (152.4 mm) so as to permit ignition of the stream of fuel from each lance separately before substantial mixing of the fuel occurs with that from another lance.

2. The blast furnace blowpipe of claim 1 characterized by two fuel injection lances spaced apart with respect to the periphery of the blowpipe at an angle within the range of from about 90 to 180 degrees.

3. The blast furnace blowpipe of claim 1 characterized by the axis of each of said lances being at an angle with respect to the centerline of the blowpipe within the range of from about 10 to about 30 degrees.

4. The blast furnace blowpipe of claim 1 characterized by two fuel injection lances spaced apart with respect to the periphery of the blowpipe at an angle within the range of from about 90 to about 180 degrees, said fuel injection lances being located on a lower half of the periphery of the blowpipe, the axis of each of said lances being at an angle with respect to the centerline of the blowpipe within the range of from about 10 to about 30 degrees.

* * * * *